US007463120B2

(12) United States Patent
Matsubara et al.

(10) Patent No.: US 7,463,120 B2
(45) Date of Patent: Dec. 9, 2008

(54) HIGH FREQUENCY FILTER

(75) Inventors: Hideya Matsubara, Tokyo (JP); Shigemitsu Tomaki, Tokyo (JP); Shinichiro Toda, Tokyo (JP); Atsunori Okada, Tokyo (JP)

(73) Assignee: TDK Corporation, Tokyo (JP)

( * ) Notice: Subject to any disclaimer, the term of this patent is extended or adjusted under 35 U.S.C. 154(b) by 214 days.

(21) Appl. No.: 11/644,007

(22) Filed: Dec. 22, 2006

(65) Prior Publication Data

US 2007/0146101 A1 Jun. 28, 2007

(30) Foreign Application Priority Data

Dec. 27, 2005 (JP) ..... 2005-373716

(51) Int. Cl.
*H01P 1/203* (2006.01)

(52) U.S. Cl. ..... 333/204; 333/26

(58) Field of Classification Search ..... 333/26, 333/175, 204, 205
See application file for complete search history.

(56) References Cited

U.S. PATENT DOCUMENTS

| | | | | |
|---|---|---|---|---|
| 6,351,239 | B1 | 2/2002 | Mizuno et al. | |
| 7,126,444 | B2 | 10/2006 | Fukunaga et al. | |
| 2004/0095212 | A1* | 5/2004 | Iwasaki et al. | 333/204 |
| 2007/0120627 | A1* | 5/2007 | Kundu | 333/203 |
| 2007/0152780 | A1* | 7/2007 | Liao et al. | 333/204 |

FOREIGN PATENT DOCUMENTS

| | | |
|---|---|---|
| JP | U 05-78003 | 10/1993 |
| JP | A 2000-022404 | 1/2000 |
| JP | A-2001-217607 | 8/2001 |
| JP | A-2002-299905 | 10/2002 |
| JP | A 2005-045447 | 2/2005 |
| JP | A 2005-080248 | 3/2005 |

OTHER PUBLICATIONS

U.S. Appl. No. 11/643,963, filed on Dec. 22, 2006 in the name of Hideya Matsubara et al.

* cited by examiner

*Primary Examiner*—Seungsook Ham
(74) *Attorney, Agent, or Firm*—Oliff & Berridge, PLC

(57) ABSTRACT

A high frequency filter comprises a first resonator and a second resonator provided inside a layered substrate. The first and second resonators are inductively coupled and capacitively coupled to each other through a first capacitor and a second capacitor connected to each other in parallel. The first capacitor is formed using first and third electrodes and a dielectric layer. The first electrode is connected to the first resonator via a through hole. The third electrode is connected to the second resonator and opposed to the first electrode. The second capacitor is formed using second and fourth electrodes and the dielectric layer. The second electrode is connected to the second resonator via a through hole. The fourth electrode is connected to the first resonator and opposed to the second electrode.

6 Claims, 5 Drawing Sheets

HIGH FREQUENCY FILTER

BACKGROUND OF THE INVENTION

1. Field of the Invention

The present invention relates to a layered high frequency filter incorporating a plurality of resonators.

2. Description of the Related Art

With increasing demands for reductions in dimensions and thickness of communications apparatuses conforming to the Bluetooth standard and those for use on a wireless local area network (LAN), techniques for high-density packaging has been required. One of proposals for meeting such a requirement is to integrate components through the use of a layered substrate.

One of components of the above-mentioned communications apparatuses is a band-pass filter that filters reception signals. As the band-pass filter, a layered band-pass filter such as the one disclosed in Japanese Published Patent Application (hereinafter referred to as "JP-A") 2000-22404 is known. The layered band-pass filter incorporates a plurality of resonators formed using conductor layers of a layered substrate. In the layered band-pass filter, respective adjacent ones of the resonators are inductively coupled to each other. For the layered band-pass filter, as disclosed in JP-A 2000-22404, there are cases in which the respective adjacent ones of the resonators are also capacitively coupled to each other. In such cases, it is possible to adjust the frequencies of two attenuation poles and the pass-band width of the band-pass filter by adjusting the magnitude of the inductive coupling and the magnitude of the capacitive coupling. Adjustment of the characteristics of the band-pass filter is thus made easier by capacitively coupling the respective adjacent ones of the resonators to each other, compared with a case in which the respective adjacent ones of the resonators are not capacitively coupled to each other.

JP-A 2000-22404 discloses a technique of capacitively coupling the respective adjacent ones of resonators through the use of a coupling adjusting electrode. The coupling adjusting electrode is opposed to each of two adjacent resonators with a dielectric layer disposed in between.

Japanese Published Utility Model Application (hereinafter referred to as "JP-U") 5-78003 discloses a layered dielectric resonator incorporating a plurality of coil conductors that serve as transmission lines. In this resonator, respective adjacent ones of the coil conductors are opposed to each other with a dielectric layer disposed in between so as to capacitively couple the respective adjacent ones of the coil conductors to each other.

According to the technique disclosed in JP-A 2000-22404, the coupling adjusting electrode is opposed to each of two adjacent resonators with a dielectric layer in between. Consequently, according to this technique, a capacitor is formed between one of the resonators and the coupling adjusting electrode, and another capacitor is formed between the other of the resonators and the coupling adjusting electrode. These two capacitors are connected to each other in series. The respective adjacent two of the resonators are capacitively coupled to each other through such two capacitors connected to each other in series.

According to the technique disclosed in JP-A 2000-22404, the composite capacitance of the two capacitors connected to each other in series is smaller than the capacitance of each of the capacitors. Therefore, in this technique, to make the composite capacitance be of a desired value, it is necessary that the area of a region required for forming each of the capacitors, that is, the area of the region in which the coupling adjusting electrode and each of the resonators are opposed to each other, be great to some extent. According to this technique, it is therefore difficult to reduce the size of the filter.

In a layered band-pass filter, it is possible to capacitively couple the respective adjacent two of the resonators to each other through the use of the technique disclosed in JP-U 5-78003. However, this case has a problem that will now be described. In layered band-pass filters, there are some cases in which, when a layered substrate is fabricated, the positional relationship among a plurality of conductor layers disposed at different locations in the direction in which the layers are stacked deviates from a desired positional relationship. This will be hereinafter called displacement of the conductor layers. According to the technique disclosed in JP-U 5-78003, since the two coil conductors are disposed at different locations in the direction in which the layers are stacked, there is a possibility that the relative positional relationship between the coil conductors may vary. If the relative positional relationship between the coil conductors varies, the magnitude of inductive coupling and the magnitude of capacitive coupling between the two coil conductors both vary. Therefore, in the case in which the respective adjacent two of the resonators of the layered band-pass filter are capacitively coupled to each other through the use of the technique disclosed in JP-U 5-78003, the magnitude of inductive coupling and the magnitude of capacitive coupling between adjacent two of the resonators both vary if the relative positional relationship between the two resonators varies due to displacement of the conductor layers. Therefore, this case has a problem that variations in characteristics of the band-pass filter are likely to increase due to the displacement of the conductor layers.

Furthermore, in the case in which the magnitude of inductive coupling and the magnitude of capacitive coupling between adjacent two of the resonators both vary when the relative positional relationship between the resonators varies, there arises a problem that it is difficult to adjust the characteristics of the band-pass filter.

OBJECTS AND SUMMARY OF THE INVENTION

It is a first object of the invention to provide a high frequency filter of a layered type incorporating a plurality of resonators, the filter being capable of achieving a reduction in size and allowing easy adjustment of characteristics thereof.

In addition to the above-mentioned first object, it is a second object of the invention to provide a high frequency filter capable of suppressing variations in characteristics resulting from displacement of conductor layers.

A high frequency filter of the invention comprises: a layered substrate including dielectric layers and conductor layers that are alternately stacked; a first resonator and a second resonator that are formed of part of the conductor layers inside the layered substrate and that are inductively coupled to each other; at least one group of first to fourth electrodes that are formed of part of the conductor layers inside the layered substrate and that capacitively couple the first and second resonators to each other; at least one first through hole provided inside the layered substrate and connecting the first resonator to the first electrode; and at least one second through hole provided inside the layered substrate and connecting the second resonator to the second electrode. The third electrode is connected to the second resonator and opposed to the first electrode with one of the dielectric layers inside the layered substrate disposed in between. The fourth electrode is connected to the first resonator and opposed to the second electrode with one of the dielectric layers inside the layered substrate disposed in between. The first capacitor is formed of the first and third electrodes and the one of the dielectric layers located between the first and third electrodes, and the second capacitor connected to the first capacitor in parallel is formed of the second and fourth electrodes and the one of the dielectric layers located between the second and fourth electrodes.

In the high frequency filter of the invention, the first electrode connected to the first resonator via the first through hole and the third electrode connected to the second resonator are opposed to each other with one of the dielectric layers disposed in between, thereby constituting the first capacitor. In addition, the second electrode connected to the second resonator via the second through hole and the fourth electrode connected to the first resonator are opposed to each other with one of the dielectric layers disposed in between, thereby constituting the second capacitor. The second capacitor is connected to the first capacitor in parallel. The first and second resonators are capacitively coupled to each other through the first and second capacitors.

In the high frequency filter of the invention, the first and second resonators may be disposed on an identical one of the dielectric layers inside the layered substrate.

In the high frequency filter of the invention, the first and second resonators and the third and fourth electrodes may be disposed on an identical one of the dielectric layers inside the layered substrate.

In the high frequency filter of the invention, the first and second electrodes may be disposed on an identical one of the dielectric layers inside the layered substrate, and the third and fourth electrodes may be disposed on another identical one of the dielectric layers inside the layered substrate.

In the high frequency filter of the invention, each of the first and second resonators may be a half-wave resonator with open ends, and two groups of the first to fourth electrodes may be provided. In addition, one of the groups of the first to fourth electrodes may couple one of ends of the first resonator to one of ends of the second resonator, while the other of the groups of the first to fourth electrodes may couple the other of the ends of the first resonator to the other of the ends of the second resonator. In this case, the high frequency filter of the invention may further comprise an unbalanced input/output terminal for receiving or outputting unbalanced signals, and two balanced input/output terminals for receiving or outputting balanced signals, wherein the first and second resonators may be provided between the unbalanced input/output terminal and the balanced input/output terminals for the sake of circuit configuration.

In the high frequency filter of the invention, the first and second resonators are capacitively coupled to each other through the first and second capacitors connected to each other in parallel. According to the invention, it is easier to adjust characteristics of the high frequency filter, compared with a case in which the first and second resonators are not capacitively coupled to each other. In addition, according to the invention, it is possible that the area of the region required for forming the capacitors for capacitively coupling the first and second resonators to each other is made smaller, compared with a case in which the first and second resonators are capacitively coupled to each other through two capacitors connected to each other in series. It is thereby possible to achieve a reduction in dimensions of the high frequency filter.

In the high frequency filter of the invention, the first and second resonators may be disposed on an identical one of the dielectric layers inside the layered substrate. In this case, the magnitude of inductive coupling between the first and second resonators will not vary even if there occurs displacement of the conductor layers. Therefore, in this case, it is possible to suppress variations in characteristics resulting from displacement of the conductor layers.

In the high frequency filter of the invention, the first and second resonators and the third and fourth electrodes may be disposed on an identical one of the dielectric layers inside the layered substrate. In this case, it is possible to suppress variations in characteristics resulting from displacement of the conductor layers and to reduce loss of the high frequency filter.

In the high frequency filter of the invention, the first and second electrodes may be disposed on an identical one of the dielectric layers inside the layered substrate, and the third and fourth electrodes may be disposed on another identical one of the dielectric layers inside the layered substrate. In this case, it is possible to suppress variations in magnitude of capacitive coupling between the first and second resonators even if the relative positional relationship between the first and second electrodes and the third and fourth electrodes varies due to displacement of the conductor layers. Therefore, in this case, it is possible to suppress variations in characteristics resulting from displacement of the conductor layers.

Other and further objects, features and advantages of the invention will appear more fully from the following description.

DETAILED DESCRIPTION OF PREFERRED EMBODIMENT

Figure 1:
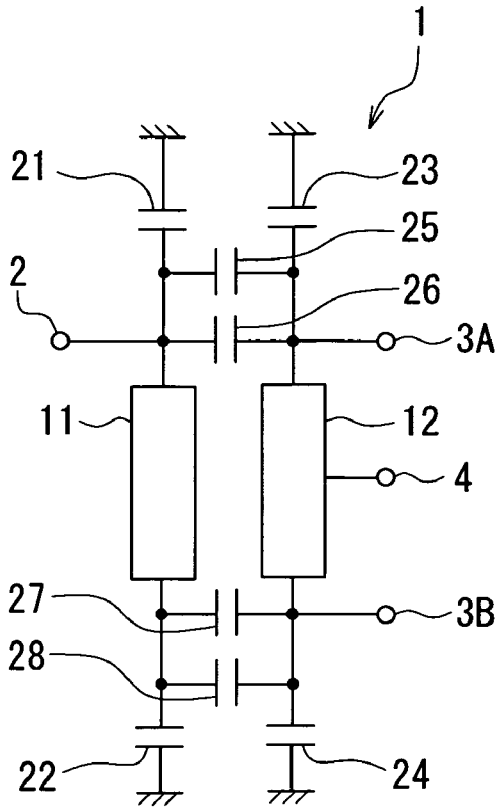
FIG. 1 is a schematic diagram illustrating the circuit configuration of a high frequency filter of an embodiment of the invention.
Figure 2:
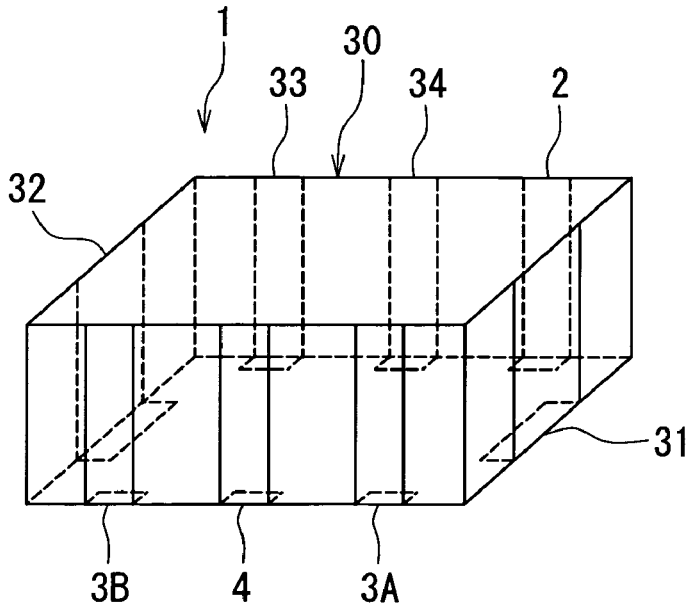
FIG. 2 is a perspective view illustrating an appearance of the high frequency filter of the embodiment of the invention.
Figure 3:
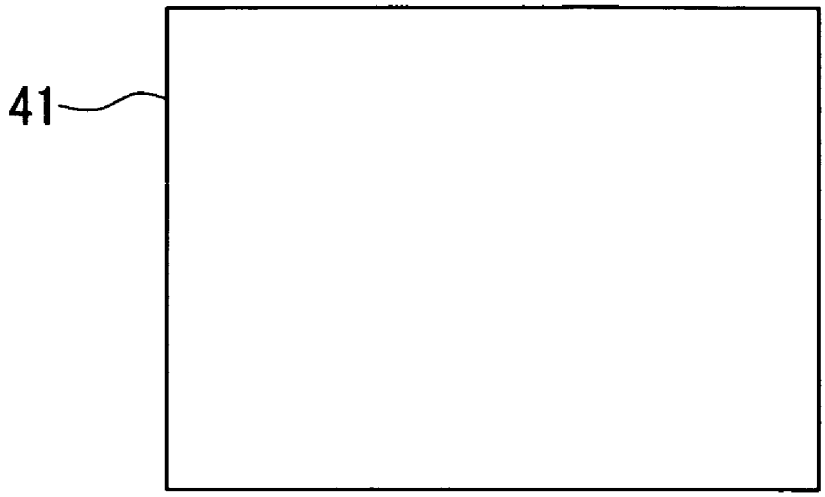
FIG. 3 is a top view of the top surface of a first dielectric layer of the layered substrate of FIG. 2.

A preferred embodiment of the invention will now be described in detail with reference to the accompanying drawings. Reference is now made to FIG. 1 and FIG. 2 to describe the configuration of a high frequency filter of the embodiment of the invention. FIG. 1 is a schematic diagram illustrating the circuit configuration of the high frequency filter of the embodiment. FIG. 2 is a perspective view illustrating an appearance of the high frequency filter of the embodiment.

As shown in FIG. 1, the high frequency filter 1 of the embodiment comprises: one unbalanced input/output terminal 2 for receiving or outputting unbalanced signals; two balanced input/output terminals 3A and 3B for receiving or outputting balanced signals; a terminal 4 for direct-current voltage application; and resonators 11 and 12 each of which comprises a TEM line. The resonators 11 and 12 are provided between the unbalanced input/output terminal 2 and the balanced input/output terminals 3A and 3B for the sake of the circuit configuration. The TEM line is a transmission line for transmitting transverse electromagnetic (TEM) waves that are electromagnetic waves whose electric field and magnetic field exist only in a cross section orthogonal to the direction of travel of the electromagnetic waves.

Each of the resonators 11 and 12 is a half-wave resonator with open ends, and has a shape that is long in one direction. The resonators 11 and 12 are disposed to be adjacent to each other in parallel and are inductively coupled to each other. The resonator 11 corresponds to the first resonator of the invention and the resonator 12 corresponds to the second resonator of the invention.

The unbalanced input/output terminal 2 is connected to one of the ends of the resonator 11. The balanced input/output terminal 3A is connected to one of the ends of the resonator 12. The balanced input/output terminal 3B is connected to the other of the ends of the resonator 12. The terminal 4 for direct-current voltage application is connected to the resonator 12 at a point near the lengthwise middle of the resonator 12.

The high frequency filter 1 further comprises: a capacitor 21 provided between the one of the ends of the resonator 11 and the ground; a capacitor 22 provided between the other of the ends of the resonator 11 and the ground; a capacitor 23 provided between the one of the ends of the resonator 12 and the ground; and a capacitor 24 provided between the other of the ends of the resonator 12 and the ground.

The high frequency filter 1 further comprises: two capacitors 25 and 26 provided between the one of the ends of the resonator 11 and the one of the ends of the resonator 12; and two capacitors 27 and 28 provided between the other of the ends of the resonator 11 and the other of the ends of the resonator 12. The capacitors 25 and 26 are connected to each other in parallel. The capacitors 27 and 28 are also connected to each other in parallel.

As shown in FIG. 2, the high frequency filter 1 incorporates a layered substrate 30 for integrating components of the high frequency filter 1. The layered substrate 30 includes dielectric layers and conductor layers alternately stacked, which will be described in detail later. The resonators 11 and 12 are formed using part of the conductor layers inside the layered substrate 30. The resonators 11 and 12 are distributed constant lines. The capacitors 21 to 28 are formed using the conductor layers and the dielectric layers inside the layered substrate 30.

The resonators 11 and 12 are inductively coupled to each other as previously mentioned, and are also capacitively coupled to each other through the capacitors 25 to 28. The resonators 11 and 12 form a band-pass filter that selectively allows signals at frequencies within a specific frequency band to pass. The frequency of two attenuation poles and the pass band width of the band-pass filter are adjustable through adjusting the magnitude of inductive coupling and the magnitude of capacitive coupling between the resonators 11 and 12.

The operation of the high frequency filter 1 of the embodiment will now be described. If unbalanced signals are inputted to the unbalanced input/output terminal 2 of the high frequency filter 1, signals at frequencies within a specific frequency band among these unbalanced signals are selectively allowed to pass through the band-pass filter formed of the resonators 11 and 12. There is a 180-degree difference in phase of the electric field between one half portion and the other half portion of each of the resonators 11 and 12 along the longitudinal direction. Consequently, voltages outputted from the balanced input/output terminals 3A and 3B are 180-degree out of phase with each other. Therefore, balanced signals are outputted from the balanced input/output terminals 3A and 3B. On the contrary, if balanced signals are inputted to the balanced input/output terminals 3A and 3B, signals at frequencies within a specific frequency band among these balanced signals are selectively allowed to pass through the band-pass filter formed of the resonators 11 and 12, and unbalanced signals are outputted from the unbalanced input/output terminal 2. As thus described, the high frequency filter 1 of the embodiment has both a function of a band-pass filter and a function of a balun.

The terminal 4 for direct-current voltage application is used for applying a direct-current voltage to the resonator 12. This direct-current voltage may be used for driving an integrated circuit connected to the balanced input/output terminals 3A and 3B, for example. It is not necessarily required to provide the terminal 4 in the high frequency filter 1.

Reference is now made to FIG. 2 to FIG. 9 to describe the configuration of the layered substrate 30 in detail. As shown in FIG. 2, the layered substrate 30 has a shape of rectangular solid having a top surface, a bottom surface, and four side surfaces. On the side surfaces and the bottom surface of the layered substrate 30, there are disposed the terminals 2, 3A, 3B and 4, two ground terminals 31 and 32, and two terminals 33 and 34. The terminals 33 and 34 are connected to neither the conductor layers inside the layered substrate 30 nor external circuits.

FIG. 3 to FIG. 8 respectively illustrate top surfaces of the first dielectric layer to the sixth (lowest) dielectric layer from the top. FIG. 9 illustrates the sixth dielectric layer and a conductor layer therebelow seen from above. No conductor layer is formed on the top surface of the first dielectric layer 41 of FIG. 3.

Figure 4:
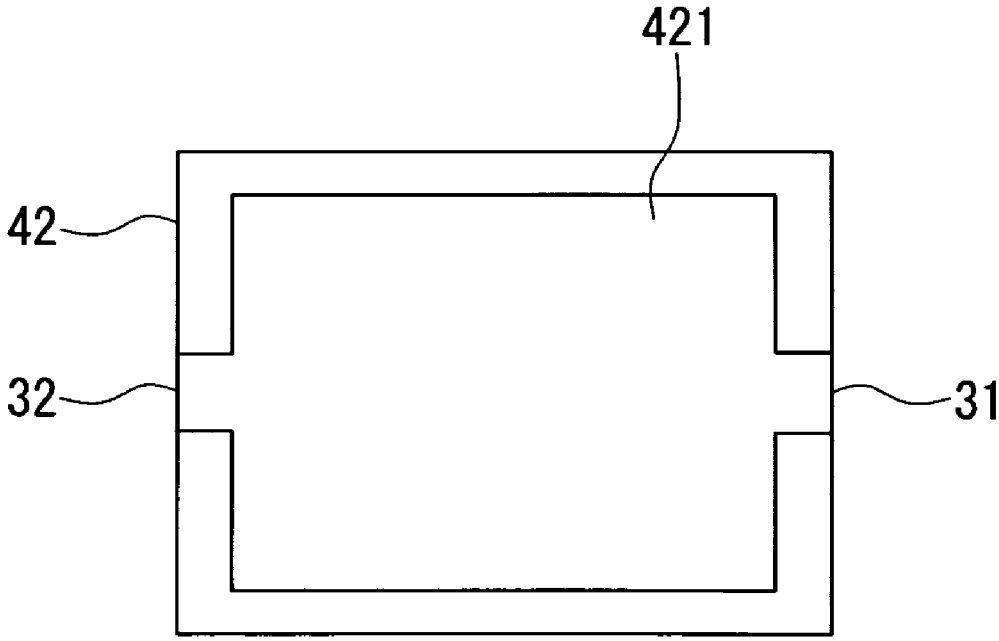
FIG. 4 is a top view of the top surface of a second dielectric layer of the layered substrate of FIG. 2.

A conductor layer 421 for grounding is formed on the top surface of the second dielectric layer 42 of FIG. 4. The conductor layer 421 is connected to the ground terminals 31 and 32.

Figure 5:
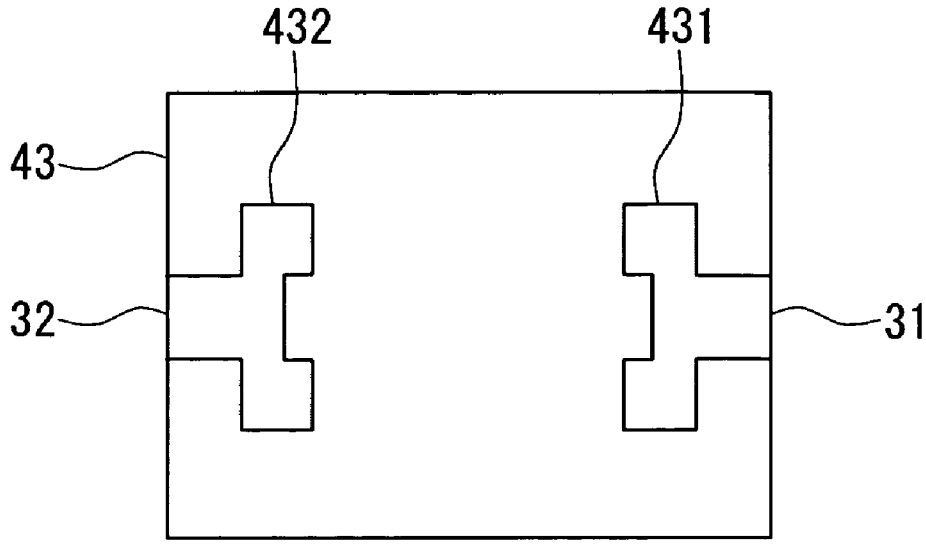
FIG. 5 is a top view of the top surface of a third dielectric layer of the layered substrate of FIG. 2.

Conductor layers 431 and 432 for grounding are formed on the top surface of the third dielectric layer 43 of FIG. 5. The conductor layers 431 and 432 are connected to the ground terminals 31 and 32, respectively.

Figure 6:
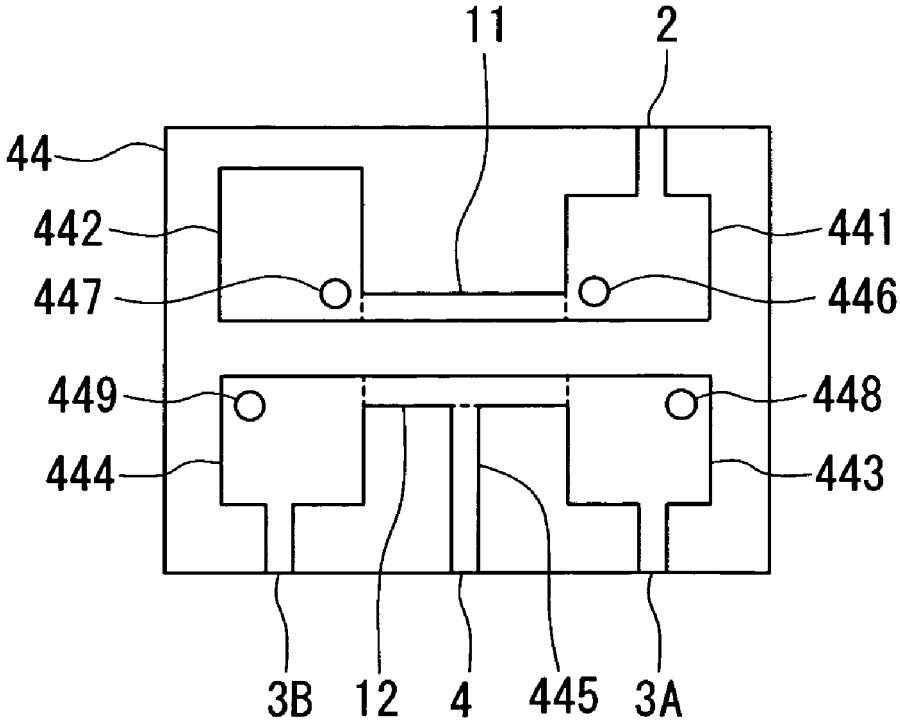
FIG. 6 is a top view of the top surface of a fourth dielectric layer of the layered substrate of FIG. 2.

The resonators 11 and 12 are formed on the top surface of the fourth dielectric layer 44 of FIG. 6. The resonators 11 and 12 are disposed adjacent to each other in parallel and are inductively coupled to each other on this dielectric layer 44.

Furthermore, conductor layers 441, 442, 443 and 444 for electrodes are formed on the top surface of the dielectric layer 44. The conductor layer 441 is physically and electrically connected to one of the ends of the resonator 11 and to the unbalanced input/output terminal 2. The conductor layer 442 is physically and electrically connected to the other of the ends of the resonator 11. The conductor layer 443 is physically and electrically connected to one of the ends of the resonator 12 and to the balanced input/output terminal 3A. The conductor layer 444 is physically and electrically connected to the other of the ends of the resonator 12 and to the balanced input/output terminal 3B.

A conductor layer 445 is further formed on the top surface of the dielectric layer 44. An end of the conductor layer 445 is connected to the resonator 12 at the point near the lengthwise middle of the resonator 12. The other end of the conductor layer 445 is connected to the terminal 4 for direct-current voltage application.

The dielectric layer 44 has: a through hole 446 connected to the conductor layer 441; a through hole 447 connected to the conductor layer 442; a through hole 448 connected to the conductor layer 443; and a through hole 449 connected to the conductor layer 444.

The conductor layers 441 and 443 are opposed to the conductor layer 431 of FIG. 5 with the dielectric layer 43 of FIG. 5 disposed in between. The capacitor 21 of FIG. 1 is formed of the conductor layers 441 and 431 and the dielectric layer 43. The capacitor 23 of FIG. 1 is formed of the conductor layers 443 and 431 and the dielectric layer 43.

The conductor layers 442 and 444 are opposed to the conductor layer 432 of FIG. 5 with the dielectric layer 43 of FIG. 5 disposed in between. The capacitor 22 of FIG. 1 is formed of the conductor layers 442 and 432 and the dielectric layer 43. The capacitor 24 of FIG. 1 is formed of the conductor layers 444 and 432 and the dielectric layer 43.

Figure 7:
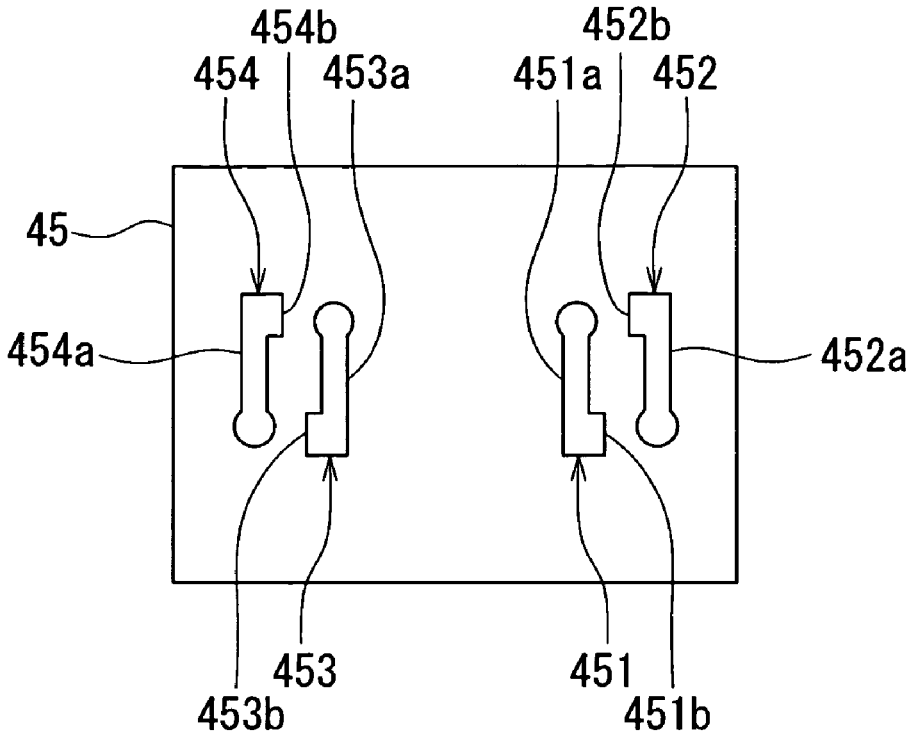
FIG. 7 is a top view of the top surface of a fifth dielectric layer of the layered substrate of FIG. 2.

Conductor layers 451, 452, 453 and 454 are formed on the top surface of the fifth dielectric layer 45 of FIG. 7. The conductor layers 451, 452, 453 and 454 respectively include long and narrow portions 451*a*, 452*a*, 453*a* and 454*a*, and portions 451*b*, 452*b*, 453*b* and 454*b* that are greater in width than the portions 451*a*, 452*a*, 453*a* and 454*a*.

The conductor layer 441 is connected to an end of the portion 451*a* of the conductor layer 451 via the through hole 446 of FIG. 6. Consequently, the conductor layer 451 is physically and electrically connected to one of the ends of the resonator 11 via the through hole 446 and the conductor layer 441. An end of the portion 451*b* is coupled to the other end of the portion 451*a*. The portion 451*b* is opposed to the conductor layer 443 of FIG. 6 with the dielectric layer 44 of FIG. 6 disposed in between. The capacitor 25 of FIG. 1 is formed of the conductor layers 451 and 443 and the dielectric layer 44. The conductor layers 451 and 443 for electrode correspond to the first and third electrodes, respectively, of the one of the groups of the first to fourth electrodes of the invention. The through hole 446 corresponds to the first through hole of the invention. The capacitor 25 corresponds to the first capacitor of the invention.

The conductor layer 443 is connected to an end of the portion 452*a* of the conductor layer 452 via the through hole 448 of FIG. 6. Consequently, the conductor layer 452 is physically and electrically connected to one of the ends of the resonator 12 via the through hole 448 and the conductor layer 443. An end of the portion 452*b* is coupled to the other end of the portion 452*a*. The portion 452*b* is opposed to the conductor layer 441 of FIG. 6 with the dielectric layer 44 of FIG. 6 disposed in between. The capacitor 26 of FIG. 1 is formed of the conductor layers 452 and 441 and the dielectric layer 44. The conductor layers 452 and 441 for electrode correspond to the second and fourth electrodes, respectively, of the one of the groups of the first to fourth electrodes of the invention. The through hole 448 corresponds to the second through hole of the invention. The capacitor 26 corresponds to the second capacitor of the invention.

The conductor layer 442 is connected to an end of the portion 453*a* of the conductor layer 453 via the through hole 447 of FIG. 6. Consequently, the conductor layer 453 is physically and electrically connected to the other of the ends of the resonator 11 via the through hole 447 and the conductor layer 442. An end of the portion 453*b* is coupled to the other end of the portion 453*a*. The portion 453*b* is opposed to the conductor layer 444 of FIG. 6 with the dielectric layer 44 of FIG. 6 disposed in between. The capacitor 27 of FIG. 1 is formed of the conductor layers 453 and 444 and the dielectric layer 44. The conductor layers 453 and 444 for electrode correspond to the first and third electrodes, respectively, of the other of the groups of the first to fourth electrodes of the invention. The through hole 447 corresponds to the first through hole of the invention. The capacitor 27 corresponds to the first capacitor of the invention.

The conductor layer 444 is connected to an end of the portion 454*a* of the conductor layer 454 via the through hole 449 of FIG. 6. Consequently, the conductor layer 454 is physically and electrically connected to the other of the ends of the resonator 12 via the through hole 449 and the conductor layer 444. An end of the portion 454*b* is coupled to the other end of the portion 454*a*. The portion 454*b* is opposed to the conductor layer 442 of FIG. 6 with the dielectric layer 44 of FIG. 6 disposed in between. The capacitor 28 of FIG. 1 is formed of the conductor layers 454 and 442 and the dielectric layer 44. The conductor layers 454 and 442 for electrode correspond to the second and fourth electrodes, respectively, of the other of the groups of the first to fourth electrodes of the invention. The through hole 449 corresponds to the second through hole of the invention. The capacitor 28 corresponds to the second capacitor of the invention.

Figure 8:
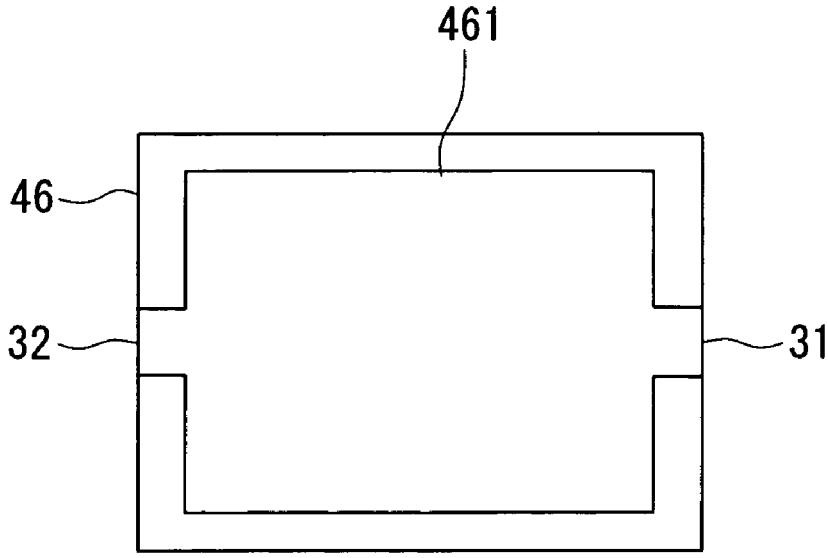
FIG. 8 is a top view of the top surface of a sixth dielectric layer of the layered substrate of FIG. 2.
Figure 9:
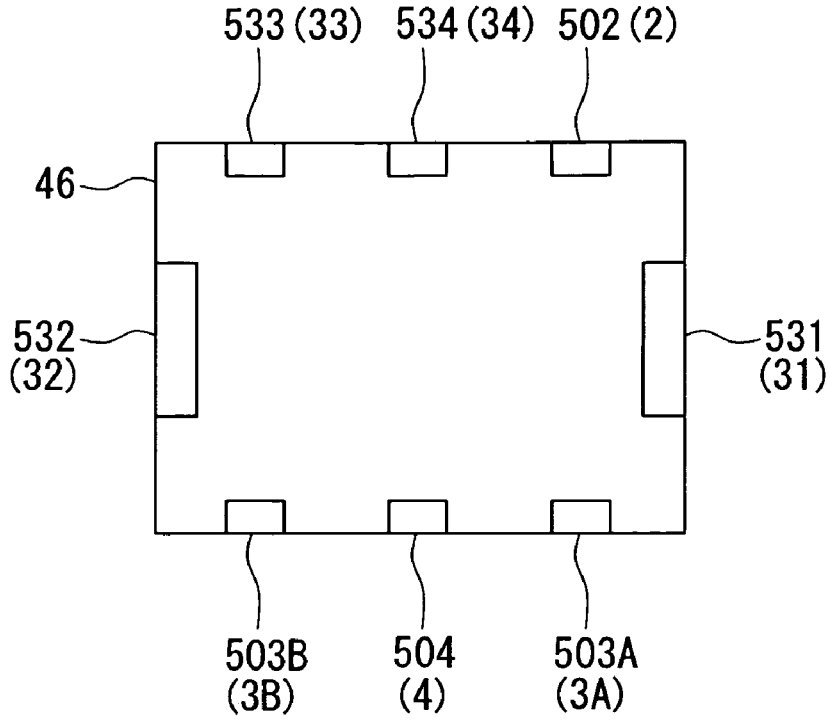
FIG. 9 is a top view illustrating the sixth dielectric layer and a conductor layer therebelow of the layered substrate of FIG. 2.

A conductor layer 461 for grounding is formed on the top surface of the sixth dielectric layer 46 of FIG. 8. The conductor layer 461 is connected to the ground terminals 31 and 32.

As shown in FIG. 9, conductor layers 502, 503A, 503B, 504, and 531 to 534 that respectively form the terminals 2, 3A, 3B, 4, and 31 to 34 are formed on the bottom surface of the dielectric layer 46, that is, on the bottom surface of the layered substrate 30.

In the embodiment the layered substrate 30 may be chosen out of a variety of types of substrates, such as one in which the dielectric layers are made of a resin, a ceramic, or a combination of these. However, it is preferred that the layered substrate 30 be a multilayer substrate of low-temperature co-fired ceramic that exhibits an excellent high frequency characteristic.

As described so far, in the high frequency filter 1 of the embodiment, the conductor layers 451 and 443 for electrode are opposed to each other with the dielectric layer 44 disposed in between. The conductor layer 451 is connected to the one of the ends of the resonator 11 via the through hole 446 and the conductor layer 441, while the conductor layer 443 is connected to the one of the ends of the resonator 12. The conductor layers 451 and 443 and the dielectric layer 44 form the capacitor 25 connecting the one of the ends of the resonator 11 to the one of the ends of the resonator 12.

In the high frequency filter 1, the conductor layers 452 and 441 for electrode are opposed to each other with the dielectric layer 44 disposed in between. The conductor layer 452 is connected to the one of the ends of the resonator 12 via the through hole 448 and the conductor layer 443, while the conductor layer 441 is connected to the one of the ends of the resonator 11. The conductor layers 452 and 441 and the dielectric layer 44 form the capacitor 26 connecting the one of the ends of the resonator 11 to the one of the ends of the resonator 12. The capacitor 26 is connected to the capacitor 25 in parallel.

In the high frequency filter 1, the conductor layers 453 and 444 for electrode are opposed to each other with the dielectric layer 44 disposed in between. The conductor layer 453 is connected to the other of the ends of the resonator 11 via the through hole 447 and the conductor layer 442, while the conductor layer 444 is connected to the other of the ends of the resonator 12. The conductor layers 453 and 444 and the dielectric layer 44 form the capacitor 27 connecting the other of the ends of the resonator 11 to the other of the ends of the resonator 12.

In the high frequency filter 1, the conductor layers 454 and 442 for electrode are opposed to each other with the dielectric layer 44 disposed in between. The conductor layer 454 is connected to the other of the ends of the resonator 12 via the through hole 449 and the conductor layer 444, while the conductor layer 442 is connected to the other of the ends of the resonator 11. The conductor layers 454 and 442 and the dielectric layer 44 form the capacitor 28 connecting the other of the ends of the resonator 11 to the other of the ends of the resonator 12. The capacitor 28 is connected to the capacitor 27 in parallel.

In such a manner, in the high frequency filter 1, the resonators 11 and 12 are capacitively coupled to each other through the capacitors 25 to 28. According to the embodiment, it is easier to adjust the characteristics of the high frequency filter 1, compared with the case in which the resonators 11 and 12 are not capacitively coupled to each other.

According to the embodiment, it is possible to reduce the area of the region required to form the capacitors 25 to 28 for capacitively coupling the resonators 11 and 12 to each other, compared with the case in which the resonators 11 and 12 are capacitively coupled to each other through two capacitors connected to each other in series. It is therefore possible to reduce the size of the high frequency filter 1.

According to the embodiment, by capacitively coupling the resonators 11 and 12 to each other, it is possible to make the physical length of the resonators 11 and 12 smaller than a half of the wavelength corresponding to the center frequency of the pass band of the band-pass filter. According to the embodiment, providing the capacitors 21 to 24 between the ground and the respective ends of the resonators 11 and 12 also makes it possible to make the physical length of the resonators 11 and 12 smaller than a half of the wavelength corresponding to the center frequency of the pass band of the band-pass filter. These features of the embodiment also allows a reduction in size of the high frequency filter 1.

According to the embodiment, it is possible to reduce the area of the region required to form the capacitors 25 to 28 for capacitively coupling the resonators 11 and 12 to each other as previously described, so that it is possible to improve the characteristics of the high frequency filter 1. That is, if the area of the region required to form the capacitors 25 to 28 is small, it is possible to increase the space around the resonators 11 and 12 where no conductor layer exists, and it is thereby possible to prevent passage of an electric field from being disturbed by conductor layers around the resonators 11 and 12. As a result, it is possible to increase the Q values of the resonators 11 and 12 and to thereby improve the characteristics of the high frequency filter 1.

According to the embodiment, the resonators 11 and 12 are disposed on the same dielectric layer 44 inside the layered substrate 30. As a result, even if there occurs displacement of the conductor layers while the layered substrate 30 is fabricated, the relative positional relationship between the resonators 11 and 12 will not vary, and the magnitude of inductive coupling between the resonators 11 and 12 will not vary, either. Therefore, according to the embodiment, it is possible to suppress variations in characteristics of the high frequency filter 1 resulting from displacement of the conductor layers.

According to the embodiment, the resonators 11 and 12 and the conductor layers 441 to 444 are disposed on the same dielectric layer 44 inside the layered substrate 30. As a result, it is possible to make the loss of the high frequency filter 1 smaller, compared with a case in which the resonators 11 and 12 and the conductor layers 441 to 444 are disposed on separate dielectric layers and these layers are connected to one another via through holes.

According to the embodiment, the conductor layers 451 and 453 as the first electrodes and the conductor layers 452 and 454 as the second electrodes are disposed on the same dielectric layer 45 inside the layered substrate 30. In addition, the conductor layers 443 and 444 as the third electrodes and the conductor layers 441 and 442 as the fourth electrodes are disposed on the same dielectric layer 44, which is different from the dielectric layer 45, inside the layered substrate 30. As a result, it is possible to suppress variations in magnitude of capacitive coupling between the resonators 11 and 12 even if the relative positional relationship between the first and second electrodes and the third and fourth electrodes varies due to displacement of the conductor layers. Therefore, according to the embodiment, it is possible to suppress variations in characteristics resulting from displacement of the conductor layers. This will now be described in detail, referring to FIG. 10.

Figure 10:
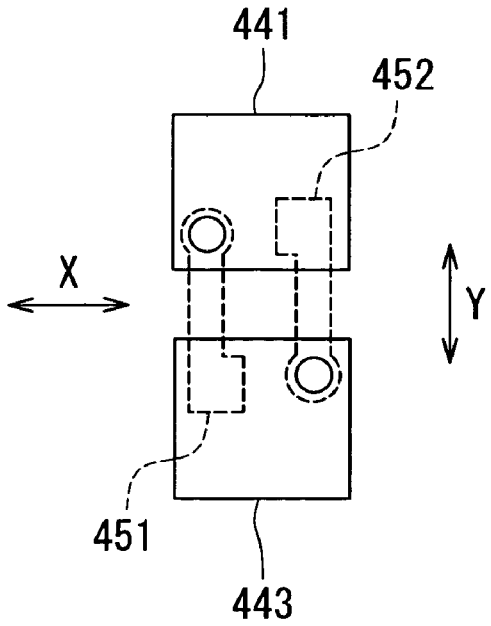
FIG. 10 is a view for illustrating the positional relationship among first to fourth electrodes of the high frequency filter of the invention.

FIG. 10 is a view for illustrating the positional relationship among the conductor layer 451 as the first electrode, the conductor layer 452 as the second electrode, the conductor layer 443 as the third electrode, and the conductor layer 441 as the fourth electrode. As shown in FIG. 10, part of the conductor layer 451 and part of the conductor layer 443 are opposed to each other, while part of the conductor layer 452 and part of the conductor layer 441 are opposed to each other. The sum of the area of the region in which the conductor layers 451 and 443 are opposed to each other and the area of the region in which the conductor layers 452 and 441 are opposed to each other is one of the parameters for determining the magnitude of capacitive coupling between the resonators 11 and 12.

In the embodiment, the conductor layers 451 and 452 are disposed on the dielectric layer 45, and the conductor layers 443 and 441 are disposed on the dielectric layer 44. As a result, there is a possibility that the relative positional relationship between the conductor layers 451, 452 and the conductor layers 443, 441 may vary due to displacement of the conductor layers. Here, as shown in FIG. 10, the direction that is parallel to the plane of the dielectric layers 44 and 45 and that is orthogonal to the longitudinal direction of the conductor layers 451 and 452 is defined as the X direction, and the longitudinal direction of the conductor layers 451 and 452 is defined as the Y direction.

The state shown in FIG. 10 is defined as a standard state for reference. Here, even if there occurs a slight shift of the relative positional relationship between the conductor layers 451, 452 and the conductor layers 443, 441 in the X direction due to displacement of the conductor layers, there is no difference in area of the region in which the conductor layers 451, 452 are opposed to the conductor layers 443, 441.

Next, consideration will be given to cases in which there occurs a shift of the relative positional relationship between the conductor layers 451, 452 and the conductor layers 443, 441 in the Y direction due to displacement of the conductor layers. First, consideration is given to a case in which the conductor layers 451 and 452 are shifted upward in FIG. 10 from the standard state relative to the conductor layers 443 and 441. In this case, the area of the region in which the conductor layers 451 and 443 are opposed to each other decreases while the area of the region in which the conductor layers 452 and 441 are opposed to each other increases, compared with the reference state. The amount of decrease in the area of the region in which the conductor layers 451 and 443 are opposed to each other and the amount of increase in the area of the region in which the conductor layers 452 and 441 are opposed to each other are equal. Therefore, in this case, there is no difference in the sum of the area of the region in which the conductor layers 451 and 443 are opposed to each other and the area of the region in which the conductor layers 452 and 441 are opposed to each other, compared with the standard state.

In a case in which the conductor layers 451 and 452 are shifted downward in FIG. 10 from the standard state relative to the conductor layers 443 and 441, the area of the region in which the conductor layers 451 and 443 are opposed to each other increases while the area of the region in which the conductor layers 452 and 441 are opposed to each other decreases, compared with the reference state. The amount of increase in the area of the region in which the conductor layers 451 and 443 are opposed to each other and the amount of decrease in the area of the region in which the conductor layers 452 and 441 are opposed to each other are equal. Therefore, in this case, there is no difference in the sum of the area of the region in which the conductor layers 451 and 443 are opposed to each other and the area of the region in which the conductor layers 452 and 441 are opposed to each other, compared with the standard state.

The foregoing also applies to the positional relationship among the conductor layer 453 as the first electrode, the conductor layer 454 as the second electrode, the conductor layer 444 as the third electrode, and the conductor layer 442 as the fourth electrode.

Therefore, according to the embodiment, it is possible to suppress variations in magnitude of capacitive coupling between the resonators 11 and 12 even if the relative positional relationship between the first and second electrodes and the third and fourth electrodes varies due to displacement of the conductor layers.

According to the embodiment as thus described, it is possible to suppress both variations in magnitude of inductive coupling between the resonators 11 and 12 and variations in magnitude of capacitive coupling between the resonators 11 and 12 even if there occurs displacement of the conductor layers. As a result, it is possible with higher reliability to suppress variations in characteristics of the high frequency filter 1 resulting from displacement of the conductor layers.

The present invention is not limited to the foregoing embodiment but may be practiced in still other ways. For example, the high frequency filter of the invention may incorporate three or more resonators disposed in such a manner that the respective adjacent ones of the resonators are inductively coupled to each other. In this case, the respective adjacent ones of the resonators may be capacitively coupled to each other through capacitors having configurations similar to those of the capacitors 25 to 28 disclosed in the embodiment.

In the embodiment the band-pass filter is formed using the resonators 11 and 12 that are half-wave resonators. However, the invention is not only applicable to such a band-pass filter but also to filters in general each incorporating at least two resonators that are inductively coupled and capacitively coupled to each other. For example, the high frequency filter of the invention may be one incorporating a plurality of quarter-wave resonators, or one incorporating a half-wave resonator and a quarter-wave resonator. In the invention, it suffices to provide at least one group of the first to fourth electrodes for capacitively coupling two resonators. For example, to capacitively couple two quarter-wave resonators to each other, it is possible by using one group of the first to fourth electrodes.

The high frequency filter of the invention is useful as a filter used in communications apparatuses conforming to the Bluetooth standard and those for use on a wireless LAN, such as a band-pass filter in particular.

Obviously many modifications and variations of the present invention are possible in the light of the above teachings. It is therefore to be understood that within the scope of the appended claims the invention may be practiced otherwise than as specifically described.

What is claimed is:

1. A high frequency filter comprising:

a layered substrate including dielectric layers and conductor layers that are alternately stacked;

a first resonator and a second resonator that are formed of part of the conductor layers inside the layered substrate and that are inductively coupled to each other;

at least one group of first to fourth electrodes that are formed of part of the conductor layers inside the layered substrate and that capacitively couple the first and second resonators to each other;

at least one first through hole provided inside the layered substrate and connecting the first resonator to the first electrode; and at least one second through hole provided inside the layered substrate and connecting the second resonator to the second electrode, wherein:

the third electrode is connected to the second resonator and opposed to the first electrode with one of the dielectric layers inside the layered substrate disposed in between;

the fourth electrode is connected to the first resonator and opposed to the second electrode with one of the dielectric layers inside the layered substrate disposed in between; and the first capacitor is formed of the first and third electrodes and the one of the dielectric layers located between the first and third electrodes, and the second capacitor connected to the first capacitor in parallel is formed of the second and fourth electrodes and the one of the dielectric layers located between the second and fourth electrodes.

2. The high frequency filter according to claim 1, wherein the first and second resonators are disposed on an identical one of the dielectric layers inside the layered substrate.

3. The high frequency filter according to claim 1, wherein the first and second resonators and the third and fourth electrodes are disposed on an identical one of the dielectric layers inside the layered substrate.

4. The high frequency filter according to claim 1, wherein the first and second electrodes are disposed on an identical one of the dielectric layers inside the layered substrate, and the third and fourth electrodes are disposed on another identical one of the dielectric layers inside the layered substrate.

5. The high frequency filter according to claim 1, wherein:

each of the first and second resonators is a half-wave resonator with open ends;

two groups of the first to fourth electrodes are provided; and one of the groups of the first to fourth electrodes couple one of ends of the first resonator to one of ends of the second resonator, while the other of the groups of the first to fourth electrodes couple the other of the ends of the first resonator to the other of the ends of the second resonator.

6. The high frequency filter according to claim 5, further comprising an unbalanced input/output terminal for receiving or outputting unbalanced signals, and two balanced input/output terminals for receiving or outputting balanced signals, wherein the first and second resonators are provided between the unbalanced input/output terminal and the balanced input/output terminals for the sake of circuit configuration.

* * * * *